US010748475B2

(12) United States Patent
Lee et al.

(10) Patent No.: US 10,748,475 B2
(45) Date of Patent: Aug. 18, 2020

(54) ORGANIC LIGHT EMITTING DISPLAY DEVICE AND DRIVING METHOD FOR THE SAME

(75) Inventors: Wook Lee, Yongin (KR); Sung-Cheon Park, Yongin (KR); Sung-Un Park, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 12/796,726

(22) Filed: Jun. 9, 2010

(65) Prior Publication Data

US 2011/0084954 A1 Apr. 14, 2011

(30) Foreign Application Priority Data

Oct. 12, 2009 (KR) ..... 10-2009-0096758

(51) Int. Cl.
*G09G 3/3225* (2016.01)
*G09G 3/32* (2016.01)
*G09G 3/3275* (2016.01)

(52) U.S. Cl.
CPC ..... *G09G 3/3225* (2013.01); *G09G 3/3275* (2013.01); *G09G 2310/0275* (2013.01); *G09G 2320/0271* (2013.01); *G09G 2330/021* (2013.01); *G09G 2330/028* (2013.01); *G09G 2340/0428* (2013.01)

(58) Field of Classification Search
CPC ..... G09G 3/3225; G09G 2330/02–028
USPC ..... 345/212
See application file for complete search history.

(56) References Cited

U.S. PATENT DOCUMENTS 6,462,735 B2 * 10/2002 Naito ..... 345/204
7,098,904 B2 * 8/2006 Kato ..... 345/211
8,035,633 B2 * 10/2011 Park ..... 345/211
(Continued)

FOREIGN PATENT DOCUMENTS

EP 2056282 A2 5/2009
KR 10-2005-0032416 4/2005
(Continued)

OTHER PUBLICATIONS

The Korean Office action issued by Korean Patent Office dated Jul. 27, 2011, corresponding to KR 10-2009-0096758 and Request for Entry attached herewith.
(Continued)

*Primary Examiner* — Xuemei Zheng
(74) *Attorney, Agent, or Firm* — H.C. Park & Associates, PLC

(57) ABSTRACT

An organic light emitting display device that includes: a pixel unit that displays an image by receiving a data signal, a scan signal, a first pixel power, and a second pixel power; a regulator that receives first input voltage from the outside and boosts the received first input voltage to generate the first pixel power and inverts the received first input voltage to generate second pixel power; a driver driving unit that includes a power generator and a signal generator generating the data signal and the scan signal. Further, a switching unit that selectively connects the pixel unit with the regulator or the pixel unit with the driver driving unit; and a control unit that transmits the first pixel power and the second pixel power generated by the regulator or the driver driving unit to the pixel unit.

6 Claims, 3 Drawing Sheets

(56) References Cited

U.S. PATENT DOCUMENTS

| | | | | |
|---|---|---|---|---|
| 8,269,703 | B2 * | 9/2012 | Park | 345/80 |
| 2003/0067289 | A1 * | 4/2003 | Morita | 323/282 |
| 2003/0095118 | A1 * | 5/2003 | Kato | 345/213 |
| 2006/0221007 | A1 * | 10/2006 | Kim | 345/76 |
| 2006/0244691 | A1 * | 11/2006 | Lee | 345/76 |
| 2006/0248420 | A1 * | 11/2006 | Jeong | 714/727 |
| 2006/0262059 | A1 * | 11/2006 | Hashimoto et al. | 345/89 |
| 2007/0290947 | A1 * | 12/2007 | Cok | 345/45 |
| 2008/0111811 | A1 * | 5/2008 | Park | 345/212 |
| 2009/0109147 | A1 * | 4/2009 | Park et al. | 345/76 |

FOREIGN PATENT DOCUMENTS

| | | | |
|---|---|---|---|
| KR | 10-2006-0043644 | A | 5/2006 |
| KR | 1020060114476 | A | 11/2006 |
| KR | 10-2008-0010789 | A | 1/2008 |
| KR | 10-2008-0068428 | | 7/2008 |
| KR | 100894606 | B1 | 4/2009 |

OTHER PUBLICATIONS

European Office Action issued by European Patent Office dated Feb. 14, 2011. European Patent Application No. 10172154.6. Corresponding to Korean patent application No. 10-2009-0096758.

Korean Office Action issued by KIPO, dated Apr. 19, 2011, corresponding to Korean Patent Application No. 10-2009-0096758, together with Request for Entry.

* cited by examiner

ORGANIC LIGHT EMITTING DISPLAY DEVICE AND DRIVING METHOD FOR THE SAME

CLAIMS OF PRIORITY

This application makes reference to, incorporates into this specification the entire contents of, and claims all benefits accruing under 35 U.S.C. § 119 from an application earlier filed in the Korean Intellectual Property Office filed on Oct. 12, 2009 and there duly assigned Serial No. 10-2009-0096758.

BACKGROUND OF THE INVENTION

Field of the Invention

The embodiment relates to an organic light emitting display (OLED) device and a driving method for the same.

Discussion of Related Art

Recently, various flat panel display devices having smaller weight and volume than a cathode ray tube have been developed and in the flat display device, a pixel unit is formed by disposing a plurality of pixels on a substrate in a matrix form and pixels are displayed on the pixel unit by connecting a scan line and a data line to each pixel and selectively applying a data signal to the pixel.

The flat panel display device is classified into a passive matrix-type display device and an active matrix-type display device in accordance with a driving scheme of the pixels and the active matrix-type that selectively lights unit pixels in terms of resolution, contrast, and operation speed is primarily used.

The flat display device is used as a display device such as a personal computer, a mobile phone, a PDA, or the like or monitors of various information equipments. An LCD using a liquid crystal panel, an organic light emitting display device using an organic light emitting device, a PDP using a plasma panel, etc. are used as the flat display device. In particular, an organic light emitting display (OLED) device that is excellent in emission efficiency, luminance, and a viewing angle and fast in response speed attract public attention.

The above information disclosed in this Related Art section is only for enhancement of understanding of the background of the invention and therefore it may contain information that does not form the prior art that is already known to a person of ordinary skill in the art.

SUMMARY OF THE INVENTION

Exemplary embodiments are disclosed for an organic light emitting display (OLED) device capable of reducing power consumption while partial driving or in a standby mode and a driving method for the same.

According to an aspect of the present invention, an organic light emitting display device includes: a pixel unit that displays an image by receiving a data signal, a scan signal, a first pixel power, and a second pixel power; a regulator that receives first input voltage from the outside and boosts the received first input voltage to generate the first pixel power and inverts the received first input voltage to generate second pixel power; a driver driving unit that includes a power generator receiving second input voltage from the outside to generate the first pixel power and the second pixel power and first driving power and second driving power and gray scale voltage and a signal generator generating the data signal and the scan signal; a switching unit that selectively connects the pixel unit with the regulator or the pixel unit with the driver driving unit; and a control unit that transmits the first pixel power and the second pixel power generated by the regulator or the driver driving unit to the pixel unit and controls the number of a plurality of voltages generated by the gray scale voltage generator to be less than the number of plural gray scale voltages generated by the regulator when the first pixel power and the second pixel power are generated by the driver driving unit.

According to another aspect, a driving method for the same includes: displaying an image by generating the first pixel power and the second pixel power in a regulator in a normal mode; and displaying the image by generating the first pixel power and the second pixel power in a driver driving unit generating the data signal and the scan signal in a partial driving mode or a standby mode, wherein driving of some amplifiers of a plurality of amplifiers generating gray scale voltage generating the data signal in the partial driving mode or the standby mode stops.

By the organic light emitting display device and a driving method for the same, the organic light emitting display device can reduce power consumption in a partial driving mode or a standby mode.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
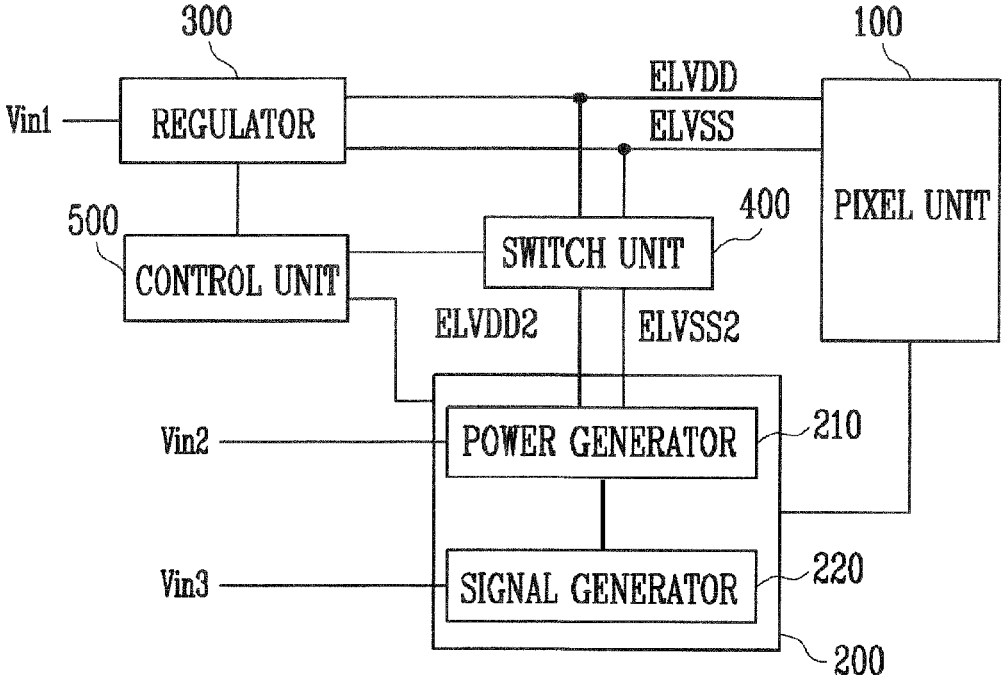
FIG. 1 (Related Art)
FIG. 1 is a conceptual diagram showing the structure of an organic light emitting display device according to an embodiment of the present invention.

Hereinafter, certain exemplary embodiments according to the present invention will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

Recognizing that sizes and thicknesses of constituent members shown in the accompanying drawings are arbitrarily given for better understanding and ease of description, the present invention is not limited to the illustrated sizes and thicknesses.

In the drawings, the thickness of layers, films, panels, regions, etc., are exaggerated for clarity. Like reference numerals designate like elements throughout the specification. It will be understood that when an element such as a layer, film, region, or substrate is referred to as being Aon@ another element, it can be directly on the other element or intervening elements may also be present. Alternatively, when an element is referred to as being Adirectly on@ another element, there are no intervening elements present.

In order to clarify the present invention, elements extrinsic to the description are omitted from the details of this description, and like reference numerals refer to like elements throughout the specification.

In several exemplary embodiments, constituent elements having the same configuration are representatively described in a first exemplary embodiment by using the same reference numeral and only constituent elements other than the constituent elements described in the first exemplary embodiment will be described in other embodiments.

In a conventional organic light emitting display (OLED) device, in case of partial driving, that is, a case in which an image is displayed only in a partial region and a remaining region is displayed as a black color and in a standby mode, that is, in a case where the image is not displayed, the image is displayed in the black color or low luminance, the organic light emitting display device has comparatively larger power consumption than an LCD. The reason for this is that the partial driving can be displayed by turning off some of backlight units and the standby mode can be displayed by turning on all backlight units so as to reduce power consumption consumed by the backlight units in case of the LCD, but in the organic light emitting display device, each pixel displays an image to correspond to the data signal and a first power supply and a second power supply. Displaying a gray scale corresponds to the data signal at the first power supply. Therefore, even when black is displayed in the pixel, a data signal representing black and the first power supply should be received.

At this time, the organic light emitting display generates the first power supply and the second power supply by using a switching regulator. The switching regulator has low efficiency due its characteristic and the organic light emitting display device needs to consume dozens of mWs in order to actuate the switching regulator, and so the organic light emitting display device has power consumption comparatively larger than the LCD.

As a result, when the organic light emitting display device is used for a portable terminal such as a mobile phone, etc., the organic light emitting display device has very large power consumption, such that the organic light emitting display device cannot be used for a long period of time.

Hereinafter, embodiments of the present invention will be described with reference to the accompanying drawings.

FIG. 1 is a conceptual diagram showing the structure of an organic light emitting display device according to an embodiment of the present invention which is also similar to FIG. 1 of U.S. 2008/0111811. Referring now to FIG. 1, the organic light emitting display device includes a pixel unit 100, a driver driving unit 200, a regulator 300, a switch unit 400, and a control unit 500.

The pixel unit 100 includes a plurality of pixels, a plurality of data lines that transmit data signals to the pixels, a plurality of scan lines that transmit a plurality of scan signals to the pixels, a first pixel power line and a second pixel power line that transmit a first pixel power and a second pixel power for driving the pixels. Herein, the second pixel power line is generally constituted by one layer covering the entirety of the pixel unit 100.

Further, the pixel unit 100 can be driven in a normal driving mode in which an image is displayed on an entire region of the pixel unit 100, a partial driving mode in which the image is displayed in a predetermined region of the pixel unit 100, and a standby mode in which the luminance of the pixel unit 100 is set to a low value when a user does not use the pixel unit 100.

In normal mode, all pixels receive data signals to display an image. In addition, in the partial driving mode, a data signal displaying a black color is transmitted to a portion of the pixel unit external to the predetermined region where the image is displayed while a normal data signal is transmitted to the predetermined region where the image is displayed. At this time, in the partial driving mode, simple information including time, date, etc, is displayed in the predetermined region where the image is displayed. Further, in the standby mode, while all the pixels receive the data signals, it is possible to reduce power consumption by reducing the luminance to a predetermined value or less.

At this time, in the partial driving mode in the standby mode, since either a part of the pixel unit 100 is driven or the luminance is low, the load of the pixel unit 100 is set to a very small value. Therefore, in comparison with the normal mode, the first pixel power and the second pixel power do not need to have large power consumption.

The driver driving unit 200 includes a power generator 210 and a signal generator 220. In addition, the power generator 210 generates a third pixel power ELVDD2 and a fourth pixel power ELVSS2, which are the voltage supplies for the pixel unit 100, and the first driving power VGH and the second driving power VGL, which are the driving power for driving the signal generator 220 by using second input voltage Vin2. The signal generator 220 includes a data driving unit and a scan driving unit, and receives the first and second driving powers VGH and VGL from the power generator 210 and third input voltage Vin3 from an outside to produce data and scan signals used to drive the pixel unit 100.

The regulator 300 receives a first input voltage Vin1 from the outside and generates and transmits a first pixel power ELVDD and a second pixel power ELVSS to the pixel unit 100. The first pixel power ELVDD and the pixel power ELVSS that are generated by the regulator 300 are transmitted to the pixel unit 100 during normal mode.

The switch unit 400 enables the first pixel power ELVDD and the second pixel power ELVSS generated by the regulator 300 to be transmitted to the pixel unit 100, and disables the third pixel power ELVDD2 and the fourth pixel power ELVSS2 generated by the power generator 210 from being transmitted to the pixel unit 100. In addition, in the partial driving mode or the standby mode, the first pixel power ELVDD and the second pixel power ELVSS that are generated by the regulator 300 are intercepted, and the third pixel power ELVDD2 and the fourth pixel power ELVSS2 that are generated by the power generator 210 are transmitted to the pixel unit 100.

The control unit 500 controls operations of the driver driving unit 200, the regulator 300, and the switch unit 400. In normal mode, the control unit 500 enables the regulator 300 to be driven and enables the switch unit 400 to connect the pixel unit 100 and the regulator 300 to each other. Therefore, the first pixel power ELVDD and the second pixel power ELVSS that are generated by the regulator 300 are transmitted to the pixel unit 100. In addition, in partial driving mode or in standby mode, the control unit 500 stops the operation of the regulator 300 while causing the switch unit 400 to connect the pixel unit 100 and the driver driving unit 200 to each other. Therefore, the third pixel power ELVDD2 and the fourth pixel power ELVSS2 that are generated by the power generator 210 of the driver driving unit 200 are transmitted to the pixel unit 100.

Figure 2:
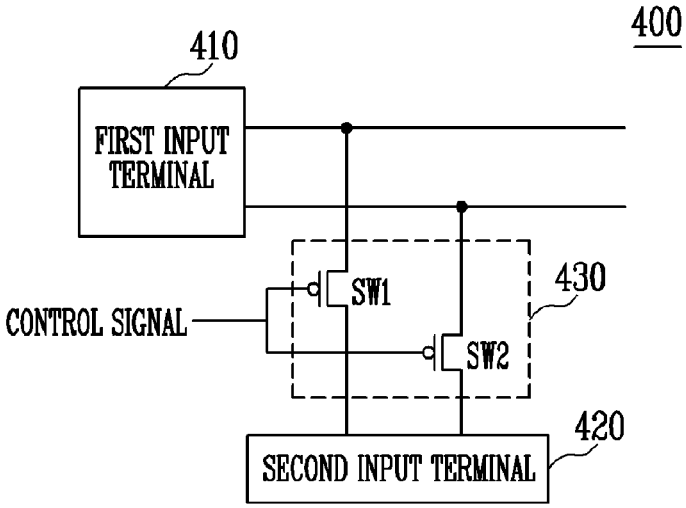
FIG. 2 (Related Art)
FIG. 2 is a circuit diagram showing a switch unit adopted in the organic light emitting display device shown in FIG. 1.

Turning now to FIG. 2, FIG. 2 is a circuit diagram showing in detail the switch unit 400 of FIG. 1 and is also similar to FIG. 2 of U.S. 2008/0111811. Referring now to FIG. 2, the switch unit 400 includes a first input terminal 410 that receives the first pixel power ELVDD and the second pixel power ELVSS from the regulator 300, a second input terminal 420 that receives the third pixel power ELVDD2 and the fourth pixel power ELVDD2 from the driver driving unit 200, and first and second switches SW1 and SW2 430 that connect the third pixel power ELVDD2 and the fourth pixel power ELVSS2 to the pixel unit 100.

A first terminal of the first input terminal 410 is connected to an output terminal of the regulator 300 and a second terminal of the first input terminal 410 is connected to the first pixel power line and the second pixel power line that transmits the first pixel power ELVDD and the second pixel power ELVSS to the pixel unit 100. In other words, the first input terminal 410 receives the first pixel power ELVDD and the second pixel power ELVSS from the regulator 400 and transmits them to the pixel unit 100.

A first terminal of the second input terminal 420 is connected to the power generator 210, and a second terminal of the second input terminal 420 is connected to the first switch SW1 and the second switch SW2 430.

The first and second switches SW1 and SW2 perform a switching operation by receiving a control signal from the control unit 500, and are connected between the second input terminal 420 and the first and second pixel power lines. In addition, when the regulator 400 is disabled, the first and second switches SW1 and SW2 are turned on to enable the third pixel power ELVDD2 and the fourth pixel power ELVSS2 generated by the driver driving unit 200 to be transmitted to the first pixel power line and the second pixel power line through the second input terminal 420.

Figure 3:
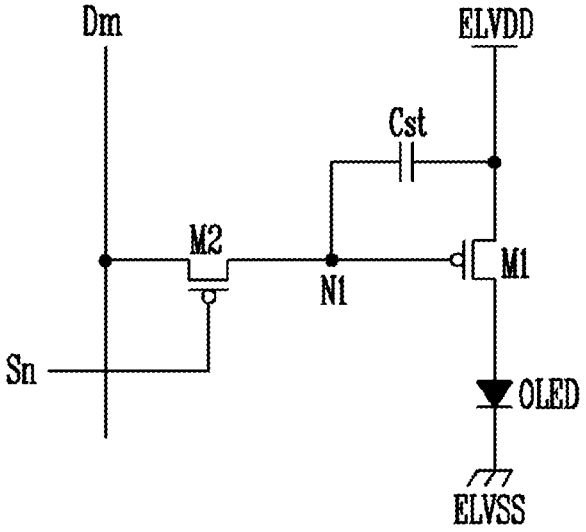
FIG. 3 (Related Art)
FIG. 3 is a circuit diagram showing an embodiment of a pixel adopted in the organic light emitting display device shown in FIG. 2.

Turning now to FIG. 3, FIG. 3 is a circuit diagram showing an embodiment of a pixel within pixel unit 100 of the organic light emitting display device shown in FIG. 1 and is also similar to FIG. 3 of U.S. 2008/011181. Referring now to FIG. 3, the pixel of the organic light emitting display device is connected to a data line Dm, a scan line Sn, the first pixel power ELVDD and the second pixel power ELVSS, and includes an organic light emitting diode OLED, a first transistor M1, a second transistor M2, and a capacitor Cst.

The organic light emitting diode OLED includes an anode electrode, a light emitting layer, and a cathode electrode. The light emitting layer includes a plurality of organic layers arranged between the anode electrode and the cathode electrode. In addition, when first pixel power ELVDD having high voltage is connected to the anode electrode and second pixel power ELVSS having lower voltage than the first pixel power ELVDD is connected to the cathode electrode, current flows from the anode electrode to the cathode electrode and through the light emitting layer so that the light emitting layer emits light corresponding to the flow of current.

A source of the first transistor M1 is connected to the first pixel power ELVDD, a drain is connected to the anode of the organic light emitting diode OLED, and a gate is connected to a first node N1 to adjust the amount of the current that flows from the anode to the cathode of the organic light emitting diode OLED in accordance with the voltage applied to the gate. That is, a light emission intensity of the organic light emitting diode OLED is controlled depending on the voltage applied to the gate of the first transistor M1.

A source of the second transistor M2 is connected to data line Dm, a drain is connected to the first node N1, and a gate is connected to scan line Sn to transmit a data signal from the data line Dm to the first node N1 according to the scan line Sn.

The capacitor Cst is connected between the first node N1 and the first pixel power ELVDD to maintain the voltage of the first node N1 for one frame time.

Figure 4:
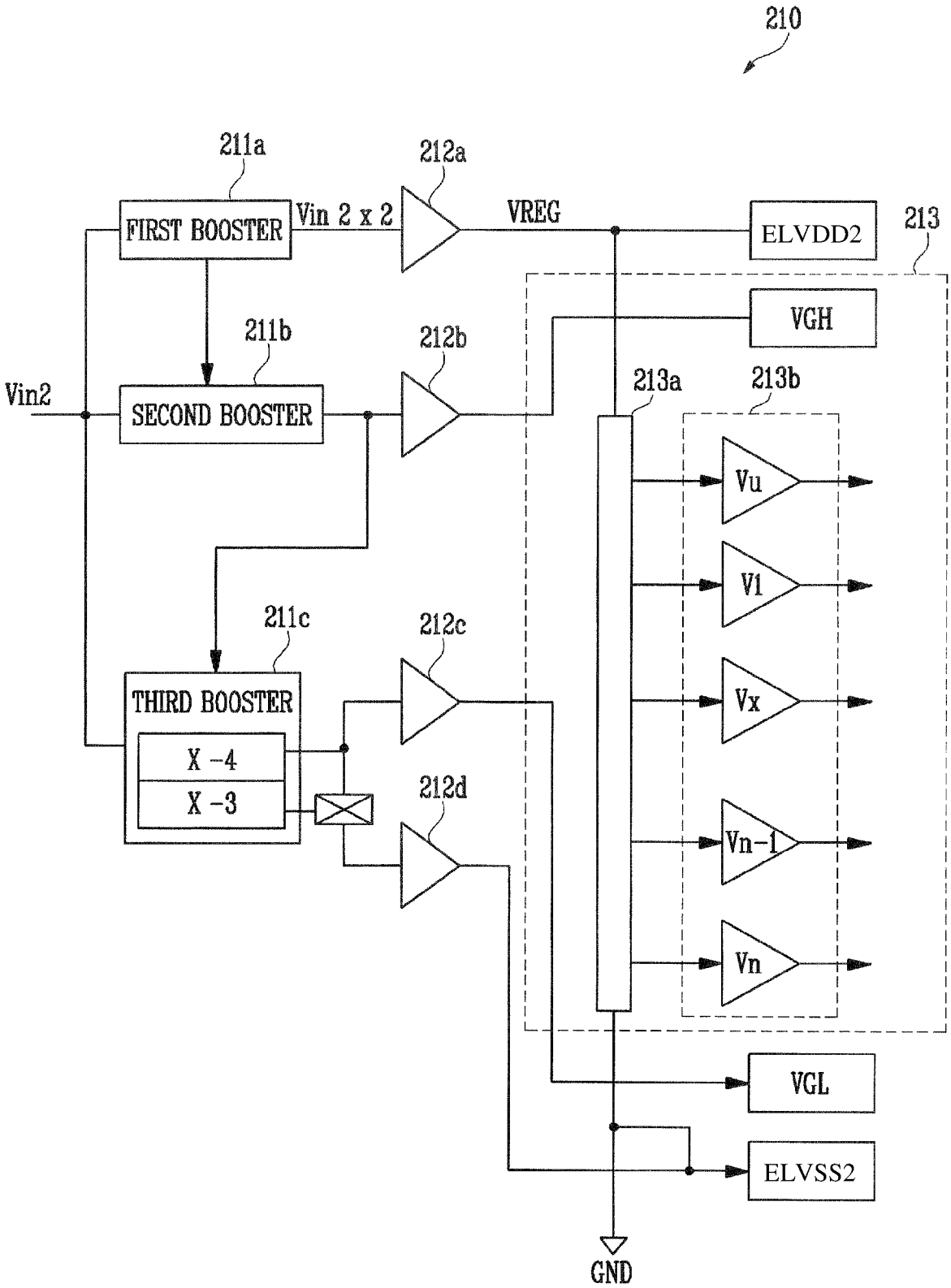
FIG. 4 is a structural diagram showing the structure of a power generator adopted in an organic light emitting display device according to an embodiment of the present invention.

Turning now to FIG. 4, FIG. 4 is a structural diagram showing in detail the structure within the power generator 210 of the organic light emitting display device illustrated in FIG. 1 according to an embodiment of the present invention. The power generator 210 includes a first booster 211*a*, a second booster 211*b*, a third booster 211*c*, and a gray scale voltage generator 213.

The first booster 211*a* boosts a second input voltage Vin2 by a factor of 2 to output signal VREG from a buffer 212*a* in order to produce third pixel power ELVDD2. The second booster 211*b* also receives the second input voltage Vin2 and as well as the output voltage of the first booster 211*a* and boosts them up to a voltage three times larger than the second input voltage Vin2 to produce first driving power VGH, and thereafter outputs the first driving power VGH through the buffer 212*b*. If the second booster 211*b* were instead to receive only the second input voltage Vin2, then second booster 211*b* would need to triple second input voltage Vin2 in order to generate the first driving voltage VGH. However, when the second booster 211*b* also receives the output voltage of the first booster 211*a*, since the output voltage of the first booster 211*a* has a voltage that is twice the second input voltage Vin2, the boosting operation within second booster 211*b* is more efficient. After the third booster 211*c* receives the output voltage of the second booster 211*b* in addition to the second input voltage Vin2, the third booster 211*c* produces second driving power VGL and fourth pixel power ELVSS2 at buffers 212*c* and 212*d* respectively. The second driving power VGL has voltage −3 times smaller than the second input voltage Vin2 and the fourth pixel power ELVSS2 has voltage −4 times of the second input voltage Vin2. In other words, if Vin2 is +1V, VGL is smaller than −3V (e.g., −3.1V) and ELVSS is smaller than −4V (e.g., −4.1V).

The gray scale voltage generator 213 operates by receiving the third pixel power ELVDD2 and the fourth pixel power ELVSS2 or ground power GND. The gray scale voltage generator 213 includes a resistor array 213*a* formed between the buffer unit 213*b* and each of the third pixel power ELVDD2 and the fourth pixel power ELVSS2 or the ground power GND, the buffer unit 213*b* to amplify and output voltages distributed by the resistor array 213*a* as gray scale voltages. The buffer unit 213*b* may include a plurality of buffers Vu, V1, Vx, Vn−1, and Vn.

At this time, in the normal mode, gray scale voltage generator within regulator 300 distributes the first pixel power EVLDD and the second pixel power ELVSS received from boosters and buffers within the regulator 300 to generate the gray scale voltages and to output all gray scale voltages by driving all buffers of the buffer unit. However, in each of the partial driving mode and the standby mode, the image does not need to display all gray scales. Therefore, even though the gray scale voltage generator generates only a part of the gray scale voltages, the image can be displayed in the partial driving mode and in the standby mode.

In either of the partial driving mode or the standby mode, since the image does not use all the gray scales, the third pixel power ELVDD2 received from the booster 211*a* of the power generator 210 and the fourth pixel power ELVSS2 received from the third booster 211*c* of the power generator 210 are transmitted to both ends of the resistor array 211*a* of the power generator 210, and only some of the buffers of the buffer unit 213*b* of the power generator 210 that can output a voltage distributed by the resistor array 211*a* are driven so that only a part of the possible gray scale voltages that can be produces are actually produced. Accordingly, the number of driven buffers is decreased within the power generator 210 as compared to the regulator 300 in order to reduce power consumption. Further, when the ground power GND is used instead of the fourth pixel power ELVSS2, the driving of the buffer 212*d* is no longer necessary, thereby further reducing power consumption.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and—equivalents thereof.

What is claimed is:

1. An organic light emitting display device configured to operate in one of a normal operating mode, a standby mode, and a partial driving mode, the device comprising:

a pixel unit that displays an image;

a regulator configured to:

receive a first input voltage from an external device, generate a first pixel power by boosting the received first input voltage, and generate a second pixel power by inverting the received first input voltage in response to the display device operating in the normal operating mode; and stop the operation in response to the display device operating in the standby mode and the partial driving mode;

a driver driving unit comprising:

a power generator configured to receive a second input voltage from the external device and generate a third pixel power, a fourth pixel power, a first driving power, and a second driving power, the power generator comprising a gray scale voltage generator configured to generate a plurality of gray scale voltages; and a signal generator configured to generate a data signal and a scan signal;

a switching unit, in response to a control signal, configured to:

disconnect the power generator from the pixel unit, in response to the display device operating in the normal operating mode; and connect the power generator with the pixel unit to transmit the third pixel power and the fourth pixel power to the pixel unit in response to the display device operating in the standby mode and a partial driving mode; and a control unit configured to:

transmit the control signal to the switching unit; and control the gray scale voltage generator of the power generator, so that a number of the plurality of the gray scale voltages generated in response to the switching unit transmitting the third pixel power and the fourth pixel power generated by the driver driving unit to the pixel unit is less than a number of the plurality of gray scale voltages generated in response to the switching unit transmitting the first pixel power and the second pixel power generated by the regulator to the pixel unit, wherein the control unit operating in the normal operating mode is configured to drive all pixels in the pixel unit to display the image at a full luminance, wherein the control unit operating in the standby mode is configured to drive all the pixels in the pixel unit to display the image at less than the full luminance, wherein the control unit operating in the partial driving mode is configured to drive some of the pixels in a first region of the pixel unit to display the image and other pixels in a second region other than the first region to display a black color, and wherein the power generator comprises:

a first booster configured to generate the third pixel power;

a second booster configured to generate the first driving power; and a third booster configured to generate the fourth pixel power and the second driving power.

2. The organic light emitting display device of claim 1, wherein the gray scale voltage generator is configured to generate the plurality of gray scale voltages by voltage-dividing the third pixel power and the fourth pixel power.

3. The organic light emitting display device of claim 2, wherein the gray scale voltage generator comprises a buffer unit comprising a plurality of buffers, the gray scale voltage generator configured to transmit the plurality of gray scale voltages generated by voltage-dividing the third pixel power and the fourth pixel power through the buffer unit, wherein the gray scale voltage generator is configured to drive only some of the plurality of buffers of the buffer unit in response to the third pixel power and the fourth pixel power being received from the first booster and the third booster.

4. The organic light emitting display device of claim 1, wherein the gray scale voltage generator is configured to generate the gray scale voltages by voltage-dividing the third pixel power and a ground power.

5. The organic light emitting display device of claim 4, wherein the gray scale voltage generator is configured to stop driving of a buffer amplifying the fourth pixel power.

6. The organic light emitting display device of claim 1, wherein the switching unit comprises a first switch and a second switch, the first switch and the second switch configured to perform a switching operation in response to the control signal, wherein the first switch and the second switch are connected between the power generator and a pixel power line, and wherein the switching unit is configured to selectively transmit the third pixel power and the fourth pixel power generated by the power generator to the pixel power line in response to the control signal.

* * * * *